US010077923B2

(12) United States Patent
Suzuki et al.

(10) Patent No.: US 10,077,923 B2
(45) Date of Patent: Sep. 18, 2018

(54) EJECTOR

(71) Applicant: DENSO CORPORATION, Kariya, Aichi-pref. (JP)

(72) Inventors: Tatsuhiro Suzuki, Kariya (JP); Haruyuki Nishijima, Obu (JP); Etsuhisa Yamada, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 618 days.

(21) Appl. No.: 14/651,498

(22) PCT Filed: Nov. 28, 2013

(86) PCT No.: PCT/JP2013/007003
§ 371 (c)(1),
(2) Date: Jun. 11, 2015

(87) PCT Pub. No.: WO2014/091701
PCT Pub. Date: Jun. 19, 2014

(65) Prior Publication Data

US 2015/0330671 A1 Nov. 19, 2015

(30) Foreign Application Priority Data

Dec. 13, 2012 (JP) ..... 2012-272099
Oct. 22, 2013 (JP) ..... 2013-219043

(51) Int. Cl.
*F04F 5/46* (2006.01)
*F25B 1/06* (2006.01)
(Continued)

(52) U.S. Cl.
CPC ..... *F25B 1/06* (2013.01); *F04F 5/04* (2013.01); *F25B 9/08* (2013.01); *F25B 41/00* (2013.01);
(Continued)

(58) Field of Classification Search
CPC ..... F25B 2341/0012; F04F 5/04; F04F 5/16; F04F 5/461
(Continued)

(56) References Cited

U.S. PATENT DOCUMENTS 1,027,825 A * 5/1912 Doble ..... F16K 5/12 137/601.01
1,067,653 A * 7/1913 Hearing ..... F04F 5/52 417/181
(Continued)

FOREIGN PATENT DOCUMENTS

CN 1415924 A 5/2003
JP S432670 B1 1/1968
(Continued)

OTHER PUBLICATIONS

U.S. Appl. No. 14/443,859, filed May 19, 2015, Nakajima et al.
(Continued)

*Primary Examiner* — Charles Freay
*Assistant Examiner* — Thomas Fink
(74) *Attorney, Agent, or Firm* — Harness, Dickey & Pierce, P.L.C.

(57) ABSTRACT

An ejector includes a body part having a depressurizing space in which a refrigerant flowing out of a swirling space is depressurized, a suction passage that draws a refrigerant from an external, and a pressurizing space in which the refrigerant from the depressurizing space is mixed with the refrigerant from the suction passage, a conical passage formation member that is arranged in the body part, and a driving device that displaces a nozzle body of the body part forming the depressurizing space. A nozzle passage is defined on an outer peripheral side of the passage formation member in the depressurizing space, a diffuser passage is formed on an outer peripheral side of the passage formation
(Continued)

member in the pressurizing space, and an actuating bar that couples the driving device with the nozzle body is arranged without crossing the diffuser passage.

10 Claims, 6 Drawing Sheets

(51) Int. Cl.
*F25B 9/08* (2006.01)
*F25B 41/06* (2006.01)
*F04F 5/04* (2006.01)
*F25B 41/00* (2006.01)

(52) U.S. Cl.
CPC ..... *F25B 41/06* (2013.01); *F04F 5/461* (2013.01); *F25B 2341/001* (2013.01); *F25B 2341/0012* (2013.01)

(58) Field of Classification Search
USPC ..... 417/196–198, 183, 184, 187, 188
See application file for complete search history.

(56) References Cited

U.S. PATENT DOCUMENTS 1,344,967 A * 6/1920 Suczek ..... F04F 5/42 417/161
3,277,660 A * 10/1966 Kemper ..... F25B 1/06 62/116
3,670,519 A * 6/1972 Newton ..... F25B 1/06 62/116
3,701,264 A * 10/1972 Newton ..... F25B 41/00 62/191
3,915,222 A * 10/1975 Hull ..... F02C 7/08 165/111
4,846,617 A * 7/1989 Ehrhardt ..... F04F 5/10 237/6
6,364,625 B1 * 4/2002 Sertier ..... F02M 37/025 417/151
6,729,158 B2 * 5/2004 Sakai ..... F04F 5/04 62/191
6,782,713 B2 * 8/2004 Takeuchi ..... B60H 1/3204 62/191
6,871,506 B2 * 3/2005 Takeuchi ..... F25B 41/00 62/170
6,877,339 B2 * 4/2005 Nishijima ..... F25B 41/00 62/116
6,904,769 B2 * 6/2005 Ogata ..... F04F 5/04 417/187
6,910,343 B2 * 6/2005 Ozaki ..... F25B 9/008 417/185
6,918,266 B2 * 7/2005 Ikegami ..... F04F 5/04 62/191
6,920,922 B2 * 7/2005 Takeuchi ..... B60H 1/00921 165/202
6,935,421 B2 * 8/2005 Takeuchi ..... B60H 1/323 165/202
6,935,513 B2 * 8/2005 Simon ..... B01D 53/00 209/150
6,966,199 B2 * 11/2005 Takeuchi ..... F04F 5/461 62/500
7,040,117 B2 * 5/2006 Nishida ..... F25B 41/00 62/500
7,178,359 B2 * 2/2007 Oshitani ..... F25B 5/00 62/500
7,254,961 B2 * 8/2007 Oshitani ..... B60H 1/323 62/500
7,559,212 B2 * 7/2009 Bergander ..... F25B 1/06 62/500
7,757,514 B2 * 7/2010 Oshitani ..... F25B 5/00 62/191
7,779,647 B2 * 8/2010 Takeuchi ..... F25B 40/00 417/151
7,870,758 B2 * 1/2011 Nishijima ..... F25B 41/00 62/116
8,047,018 B2 * 11/2011 Ikegami ..... F25B 41/00 62/170
9,759,462 B2 * 9/2017 Zou ..... F25B 41/00
2001/0025499 A1 * 10/2001 Takeuchi ..... F25B 9/008 62/175
2002/0000095 A1 * 1/2002 Takeuchi ..... F04F 5/04 62/500
2003/0079495 A1 5/2003 Hotta et al.
2004/0089019 A1 * 5/2004 Kawamura ..... F04F 5/04 62/500
2004/0172966 A1 * 9/2004 Ozaki ..... F04F 5/04 62/500
2005/0011221 A1 * 1/2005 Hirota ..... F04B 27/1804 62/500
2007/0028630 A1 * 2/2007 Yamada ..... F25B 5/00 62/170
2007/0186572 A1 * 8/2007 Nishida ..... F25B 41/00 62/170
2009/0013704 A1 * 1/2009 Oshitani ..... F25B 41/00 62/191
2009/0232665 A1 * 9/2009 Gocho ..... F04F 5/04 417/151
2010/0175422 A1 * 7/2010 Yamada ..... F25B 41/00 62/512
2010/0209818 A1 * 8/2010 Fukuma ..... F04F 5/20 429/513
2010/0276517 A1 * 11/2010 Alansary ..... B05B 7/0416 239/399
2013/0277448 A1 * 10/2013 Liu ..... F04F 5/461 239/11
2014/0331699 A1 * 11/2014 Higashiiue ..... F25B 41/003 62/84
2015/0033790 A1 2/2015 Yamada et al.
2016/0186782 A1 6/2016 Nakashima et al.

FOREIGN PATENT DOCUMENTS

JP S6176800 A 4/1986
JP H11257299 A 9/1999
JP 3331604 B2 10/2002
JP 2002333000 A 11/2002
JP 2003014318 A 1/2003
JP 2008202812 A 9/2008
JP 2008232458 A 10/2008
JP 2010181136 A 8/2010
JP 2010210111 A 9/2010
WO WO-2014108974 A1 7/2014

OTHER PUBLICATIONS

International Search Report and Written Opinion (in Japanese with English Translation) for PCT/JP2013/007003, dated Feb. 18, 2014; ISA/JP.

* cited by examiner

EJECTOR

CROSS REFERENCE TO RELATED APPLICATIONS

This application is a U.S. National Phase Application under 35 U.S.C. 371 of International Application No. PCT/JP2013/007003 filed on Nov. 28, 2013 and published in Japanese as WO 2014/091701 A1 on Jun. 19, 2014. This application is based on and claims the benefit of priority from Japanese Patent Applications No. 2012-272099 filed on Dec. 13, 2012, and No. 2013-219043 filed on Oct. 22, 2013. The entire disclosures of all of the above applications are incorporated herein by reference.

TECHNICAL FIELD

The present disclosure relates to an ejector that depressurizes a fluid, and draws the fluid by a suction action of an ejection fluid ejected at high speed.

BACKGROUND ART

Conventionally, an ejector has been known as a depressurizing device applied to a vapor compression refrigeration cycle device. The ejector of this type has a nozzle portion that depressurizes refrigerant, draws a gas-phase refrigerant which has flowed out of an evaporator due to a suction action of an ejection refrigerant ejected from the nozzle portion, mixes the ejection refrigerant with the suction refrigerant in a pressure increase part (diffuser portion), thereby being capable of increasing the pressure.

Therefore, in the refrigeration cycle device having the ejector as the depressurizing device (hereinafter referred to as "ejector refrigeration cycle"), a motive power consumption of the compressor can be reduced with the use of the refrigerant pressure increase action in a pressure increase part of the ejector, and a coefficient of performance (COP) of the cycle can be improved more than that of a normal refrigeration cycle device having an expansion valve as the depressurizing device.

Further, Patent Document 1 discloses an ejector having the nozzle portion which depressurizes the refrigerant in two stages as the ejector applied to the ejector refrigeration cycle. In more detail, in the ejector of Patent Document 1, the refrigerant of a high pressure liquid-phase state is depressurized into a gas-liquid two-phase state in a first nozzle, and the refrigerant that has been the gas-liquid two-phase state flows into a second nozzle.

With the above configuration, in the ejector of Patent Document 1, boiling of the refrigerant in the second nozzle is promoted to improve a nozzle efficiency as the overall nozzle portion, and the COP is to be further improved as the overall ejector refrigeration cycle.

Also, in the general ejector, a diffuser portion (pressure increase part) is coaxially arranged on an extension in an axial direction of the nozzle portion. Further, Patent Document 2 discloses that a spread angle of the diffuser portion thus arranged is relatively reduced to enable an improvement in the ejector efficiency.

The nozzle efficiency means energy conversion efficiency when a pressure energy of the refrigerant is converted into a kinetic energy in the nozzle portion. The ejector efficiency means energy conversion efficiency as the overall ejector.

PRIOR ART DOCUMENT

Patent Document

Patent Document 1: JP 3331604
Patent Document 2: JP 2003-14318 A

SUMMARY OF THE INVENTION

However, according to the present inventors' study, in the ejector of Patent Document 1, for example, a heat load of the ejector refrigeration cycle becomes low, and a refrigerant pressure difference (a difference between a high pressure and a low pressure) between a high-pressure side and a low-pressure side in the cycle is reduced. As a result, the difference between the high pressure and the low pressure is depressurized by the first nozzle, and most of the refrigerant may not be depressurized in the second nozzle. In this case, the nozzle efficiency by causing the gas-liquid two phase refrigerant to flow in the second nozzle is not improved. As a result, the refrigerant may not be sufficiently pressurized by the diffuser portion.

On the contrary, when the diffuser portion having the relatively small spread angle disclosed in Patent Document 2 may be applied to the ejector of Patent Document 1 to improve the ejector efficiency, thereby pressurizing the refrigerant sufficiently in the diffuser portion even in the low load of the ejector refrigeration cycle. However, when the diffuser portion of this type is applied, a length of the nozzle portion in the axial direction becomes longer as a whole of the ejector, resulting in a risk that a body of the ejector becomes unnecessarily longer in the normal load of the ejector refrigeration cycle.

Under the circumstances, the present inventors have proposed an ejector applied to an ejector refrigeration cycle in Japanese Patent Application No. 2012-184950 (hereinafter referred to as "example of preceding application") previously. The ejector includes a body part formed with a swirling space in which a refrigerant flowing out of a radiator swirls, a depressurizing space in which the refrigerant flowing out of the swirling space is depressurized, a suction passage communicating with a downstream side of the depressurizing space in a refrigerant flow, through which a refrigerant flowing out of the evaporator is drawn, and a pressurizing space in which the refrigerant jetted from the depressurizing space and the refrigerant drawn from the suction passage are mixed together and pressurized; and a passage formation member at least partially arranged in the depressurizing space and the pressurizing space, and having a conical shape that increases in cross-sectional area with distance from the depressurizing space. In the body part, a refrigerant passage provided between an inner peripheral surface of a portion defining the depressurizing space and an outer peripheral surface of the passage formation member is a nozzle passage functioning as a nozzle that depressurizes and jets the refrigerant flowing out of the swirling space. In the body part, a refrigerant passage provided between an inner peripheral surface of a portion defining the pressurizing space and an outer peripheral surface of the passage formation member is a diffuser passage functioning as a diffuser that mixes the jetted refrigerant with the drawn refrigerant, and pressurizes the mixed refrigerant. Further, a driving device that displaces the passage formation member to change a refrigerant passage area of the nozzle passage is provided.

In the ejector of the example of preceding application, the refrigerant swirls in the swirling space with the results that a refrigerant pressure on a swirling center side within the swirling space can be reduced to a pressure of a saturated liquid-phase refrigerant, or a pressure at which the refrigerant is depressurized and boiled (cavitation occurs). With the above operation, a larger amount of gas-phase refrigerant is present on an inner peripheral side than an outer peripheral side of a swirling center axis. This leads to a two-phase separation state in which the refrigerant has a gas single phase in the vicinity of a swirling center line within the swirling space, and has a liquid single phase around the vicinity thereof.

The refrigerant of the two-phase separation state flows into the nozzle passage, and boiling of the refrigerant is promoted by wall surface boiling and interface boiling. Therefore, the refrigerant puts into a gas-liquid mixed state in which a gas phase and a liquid phase are homogeneously mixed together in the vicinity of a minimum flow area part of the nozzle passage. Further, the refrigerant which has put into the gas-liquid mixed state in the vicinity of the minimum flow area part of the nozzle passage is blocked (choked), and a flow rate of the refrigerant in the gas-liquid mixed state is accelerated to a two-phase sonic speed.

The refrigerant thus accelerated to the two-phase sonic speed becomes an idle two-phase spray flow in which the two phases are homogeneously mixed together on a downstream side of the minimum flow area part in the nozzle passage, and the flow rate can further increase. As a result, the energy conversion efficiency (corresponding to the nozzle efficiency) in converting a pressure energy of the refrigerant into a velocity energy in the nozzle passage can be improved.

Further, in the ejector of the example of preceding application, a cross-sectional shape of the diffuser passage perpendicular to an axial direction thereof is formed in an annular shape with the employment of the passage formation member having a conical cross-sectional area which increases with distance from the depressurizing space. The shape of the diffuser passage expands along an outer periphery of the passage formation member with distance from the depressurizing space, and the refrigerant flowing through the diffuser passage is swirled.

With the above configuration, since the refrigerant flow channel for pressurizing the refrigerant in the diffuser passage can be formed in a spiral shape, an increase in the axial dimension of the diffuser passage can be restricted. As a result, the upsizing of the body of the overall ejector can be restricted. That is, according to the ejector in the example of preceding application, the higher nozzle efficiency can be exerted without upsizing the body irrespective of load variations of the refrigeration cycle.

Further, in the ejector of the example of preceding application, since the driving device that displaces the passage formation member is provided, the refrigerant passage area (passage cross-sectional area in the minimum passage area part) of the nozzle passage can change according to a load variation of the ejector refrigeration cycle. Therefore, the ejector can appropriately operate by appropriately changing the refrigerant passage area of the nozzle passage according to the load variation of the ejector refrigeration cycle.

However, in the configuration in which the driving device displaces the passage formation member for the purpose of changing the refrigerant passage area of the nozzle passage as in the ejector of the example of preceding application, a coupling member (actuating bar) that couples the driving device to the passage formation member to transmit a driving force from the driving device to the passage formation member may be arranged to cross the nozzle passage or the diffuser passage.

For example, in the configuration in which the driving device is arranged on the outer peripheral side of the passage formation member for the purpose of restraining the overall ejector from being upsized, the coupling member is liable to be arranged to cross the diffuser passage or the vicinity of an inlet and an outlet of the diffuser passage. The arrangement of the coupling member described above may produce a passage resistance to the swirling flow of the refrigerant flowing in the diffuser passage, and cause a reduction in a velocity of the refrigerant in a swirling direction.

A reduction in the velocity of the refrigerant flowing through the diffuser passage in the swirling direction shortens the spiral refrigerant flow channel for pressurizing the refrigerant in the diffuser passage. This may lead to a risk that the refrigerant could not be sufficiently pressurized in the diffuser passage.

In consideration of the above-described points, it is an objective of the present disclosure to provide an ejector capable of achieving a high nozzle efficiency and a high pressurizing performance regardless of load variations of a refrigeration cycle without upsizing the body.

According to an aspect of the present disclosure, an ejector is used for a vapor compression refrigeration cycle device. The ejector includes a body part and a passage formation member. The body part includes a swirling space in which a refrigerant flowing from a refrigerant inlet port is swirled, a depressurizing space in which the refrigerant flowing out of the swirling space is depressurized, a suction passage that communicates with a downstream side of the depressurizing space in a refrigerant flow and draws a refrigerant from an external, and a pressurizing space in which an ejection refrigerant jetted from the depressurizing space is mixed with a suction refrigerant drawn from the suction passage. The passage formation member is at least partially arranged inside the depressurizing space and inside the pressurizing space, and has a conical shape in which a cross-sectional area increases with distance from the depressurizing space. The body part includes at least a nozzle body defining the depressurizing space. A refrigerant passage provided between an inner peripheral surface of a portion of the nozzle body, which defines the depressurizing space, and an outer peripheral surface of the passage formation member is a nozzle passage functioning as a nozzle that depressurizes and jets the refrigerant flowing out of the swirling space. A refrigerant passage provided between an inner peripheral surface of a portion of the body part, which defines the pressurizing space, and an outer peripheral surface of the passage formation member is a diffuser passage functioning as a diffuser that pressurizes a mixture of the ejection refrigerant and the suction refrigerant. The diffuser passage has an annular shape in a cross-section surface perpendicular to an axial direction of the passage formation member. The ejector further includes a driving device that displaces the nozzle body relative to the passage formation member to change a refrigerant passage area of the nozzle passage.

According to the above configuration, the energy conversion efficiency (corresponding to the nozzle efficiency) in the nozzle passage can be improved by swirling the refrigerant in the swirling space as with the example of preceding application. Further, an increase in the axial dimension of the diffuser passage can be restricted by swirling the refrigerant flowing through the diffuser passage. Further, since the driving device is provided, the ejector can appropriately operate.

In addition, since the driving device displaces the nozzle body for changing the refrigerant passage area of the nozzle passage, a configuration that does not interferes the swirling flow of the refrigerant flowing through the diffuser passage can be easily realized as a configuration in which the driving force is transmitted from the driving device to the nozzle body.

In other words, the configuration that does not reduce the velocity of the refrigerant flowing through the diffuser passage in the swirling direction can be easily realized as the configuration in which the driving force is transmitted from the driving device to the nozzle body. Therefore, a reduction in the spiral refrigerant flow channel for pressurizing the refrigerant in the diffuser passage is restricted, thereby being capable of suppressing a reduction in the pressurizing amount of refrigerant in the diffuser passage.

This makes it possible to provide the ejector capable of achieving a high energy conversion efficiency (corresponding to the nozzle efficiency) in the nozzle passage, and also achieving a high pressurizing performance in the diffuser passage, regardless of load variations of a refrigeration cycle device without upsizing the body.

Further, the refrigerant flowing in the diffuser passage may swirl in the same direction as that of the refrigerant swirling in the swirling space. The spiral refrigerant flow channel for pressurizing the refrigerant in the diffuser passage is effectively restrained from being shortened, thereby being capable of effectively suppressing a reduction in the pressurizing amount of the refrigerant in the diffuser passage.

In more detail, as a configuration for transmitting the driving force from the driving device to the nozzle body, a coupling member that couples the driving device to the nozzle body may be provided. In that case, the coupling member may be arranged so as not to cross the diffuser passage. The coupling member may be arranged outside of the diffuser passage so that the coupling member does not block a flow of the refrigerant flowing in the diffuser passage.

According to the above configuration, the coupling member having the configuration in which the driving force is transmitted from the driving device to the nozzle body can extremely easily realize the configuration in which the velocity of the refrigerant flowing through the diffuser passage in the swirling direction is not reduced.

The passage formation member is not strictly limited to one having only the shape in which the sectional area increases with distance from the depressurizing space. At least a part of the passage formation member may include a shape expanding outward with distance from the depressurizing space, and the diffuser passage has a shape expanding outward with distance from the depressurizing space according to the shape of the passage formation member.

In addition, the "formed into a conical shape" is not limited to a meaning that the passage formation member is formed into a complete conical shape, but also includes a shape close to cone or a shape partially including the conical shape. Specifically, the cross-sectional shape taken along the axial direction is not limited to an isosceles triangle, but includes a shape in which two sides between which an apex is sandwiched are convexed on a radially inner side, a shape in which the two sides between which the apex is sandwiched are convexed on a radially outer side, and a shape in which the cross-sectional shape is semicircular.

EMBODIMENTS FOR EXPLOITATION OF THE INVENTION

Figure 1:
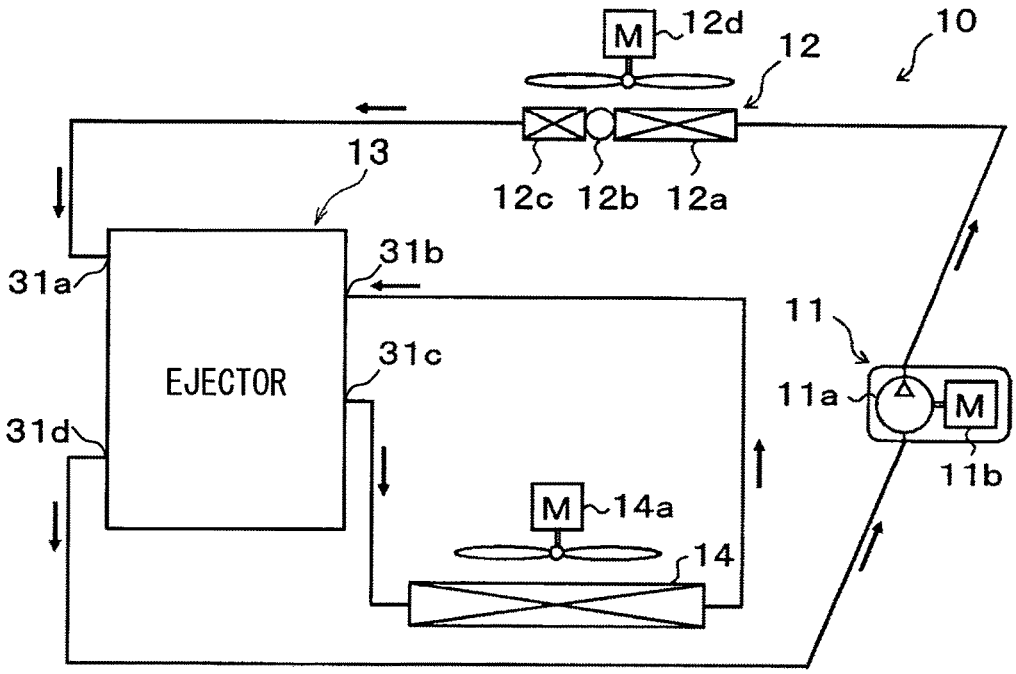
FIG. 1 is a schematic diagram of an ejector refrigeration cycle according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described with reference to FIGS. 1 to 5. As illustrated in FIG. 1, an ejector 13 according to this embodiment is applied to a refrigeration cycle device having an ejector as refrigerant depressurizing means, that is, an ejector refrigeration cycle 10. Moreover, the ejector refrigeration cycle 10 is applied to a vehicle air conditioning apparatus, and performs a function of cooling blast air which is blown into a vehicle interior that is a space to be air-conditioned.

First, in the ejector refrigeration cycle 10, a compressor 11 draws a refrigerant, pressurizes the refrigerant to a high pressure refrigerant, and discharges the refrigerant. Specifically, the compressor 11 of this embodiment is an electric compressor in which a fixed-capacity compression mechanism 11*a* and an electric motor 11*b* for driving the compression mechanism 11*a* are accommodated in a single housing.

Various compression mechanisms, such as a scroll-type compression mechanism and a vane-type compression mechanism, can be employed as the compression mechanism 11*a*. Further, the operation (rotating speed) of the electric motor 11*b* is controlled according to a control signal that is output from a control device to be described below, and any one of an AC motor and a DC motor may be employed as the electric motor 11*b*.

A refrigerant inlet side of a condenser 12*a* of a heat radiator 12 is connected to a discharge port of the compressor 11. The heat radiator 12 is a radiation heat exchanger for heat radiation which cools a high-pressure refrigerant, which is discharged from the compressor 11, through the radiation of heat by exchanging heat between the high-pressure refrigerant and vehicle exterior air (outside air) that is blown by a cooling fan 12*d*.

More specifically, the heat radiator 12 is a so-called subcooling condenser including: the condenser 12*a* that condenses a high-pressure gas-phase refrigerant, which is discharged from the compressor 11, by exchanging heat between the high-pressure gas-phase refrigerant and the outside air, which is blown from the cooling fan 12*d*, to radiate the heat of the high-pressure gas-phase refrigerant; a receiver part 12*b* that separates gas and liquid of the refrigerant having flowed out of the condenser 12*a* and stores a surplus liquid-phase refrigerant; and a subcooling portion 12*c* that subcools a liquid-phase refrigerant having flowed out of the receiver part 12*b* by exchanging heat between the liquid-phase refrigerant and the outside air blown from the cooling fan 12*d*.

Meanwhile, the ejector refrigeration cycle 10 employs an HFC based refrigerant (specifically, R134a) as the refrigerant, and forms a subcritical refrigeration cycle in which a high pressure side refrigerant pressure does not exceed a critical pressure of the refrigerant. The ejector refrigeration cycle 10 may employ an HFO based refrigerant (specifically, R1234yf) or the like as the refrigerant. Furthermore, refrigerator oil for lubricating the compressor 11 is mixed with the refrigerant, and a part of the refrigerator oil circulates in the cycle together with the refrigerant.

The cooling fan 12*d* is an electric blower of which the rotating speed (the amount of blast air) is controlled by a control voltage output from the control device. A refrigerant inlet port 31*a* of the ejector 13 is connected to a refrigerant outlet side of the subcooling portion 12*c* of the heat radiator 12.

The ejector 13 functions as refrigerant depressurizing means for depressurizing the high pressure liquid-phase refrigerant of the subcooling state, which flows out from the heat radiator 12, and allowing the refrigerant to flow out to the downstream side, and also functions as refrigerant circulating means (refrigerant transport means) for sucking (transporting) the refrigerant flowing out from an evaporator 14 to be described later by the suction action of a refrigerant flow ejected at high speed to circulate the refrigerant. Further, the ejector 13 according to this embodiment also functions as gas-liquid separation means for separating the depressurized refrigerant into gas and liquid.

A specific configuration of the ejector 13 will be described with reference to FIGS. 2 to 4. Meanwhile, up and down arrows in FIG. 2 indicate, respectively, up and down directions in a state where the ejector refrigeration cycle 10 is mounted on a vehicle air conditioning apparatus. Also, FIG. 3 is a schematic cross-sectional view illustrating functions of the respective refrigerant passages of the ejector 13, and the same parts as those in FIG. 2 are denoted by identical symbols.

Figure 2:
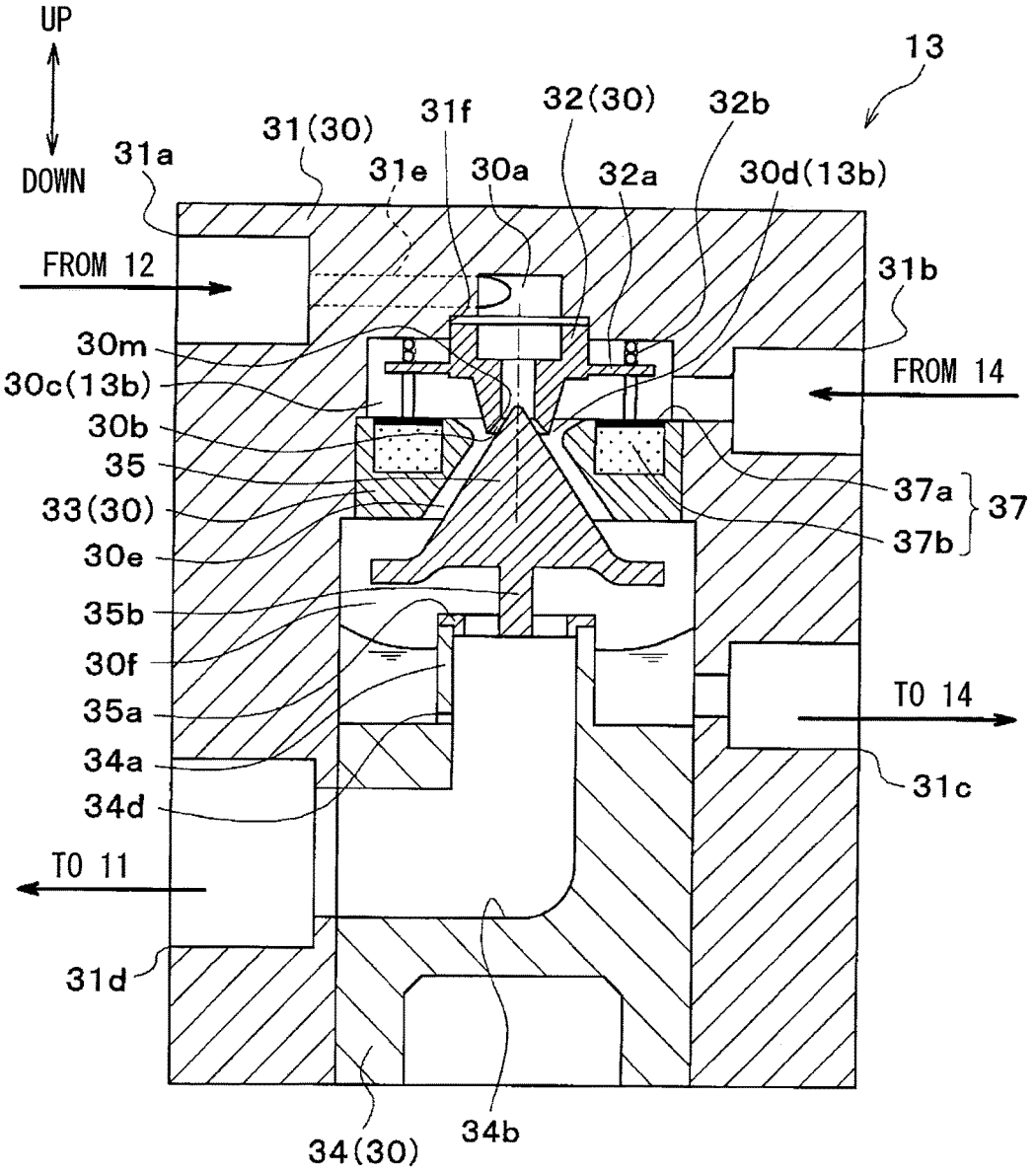
FIG. 2 is a sectional view taken along an axial direction of the ejector according to the first embodiment.
Figure 3:
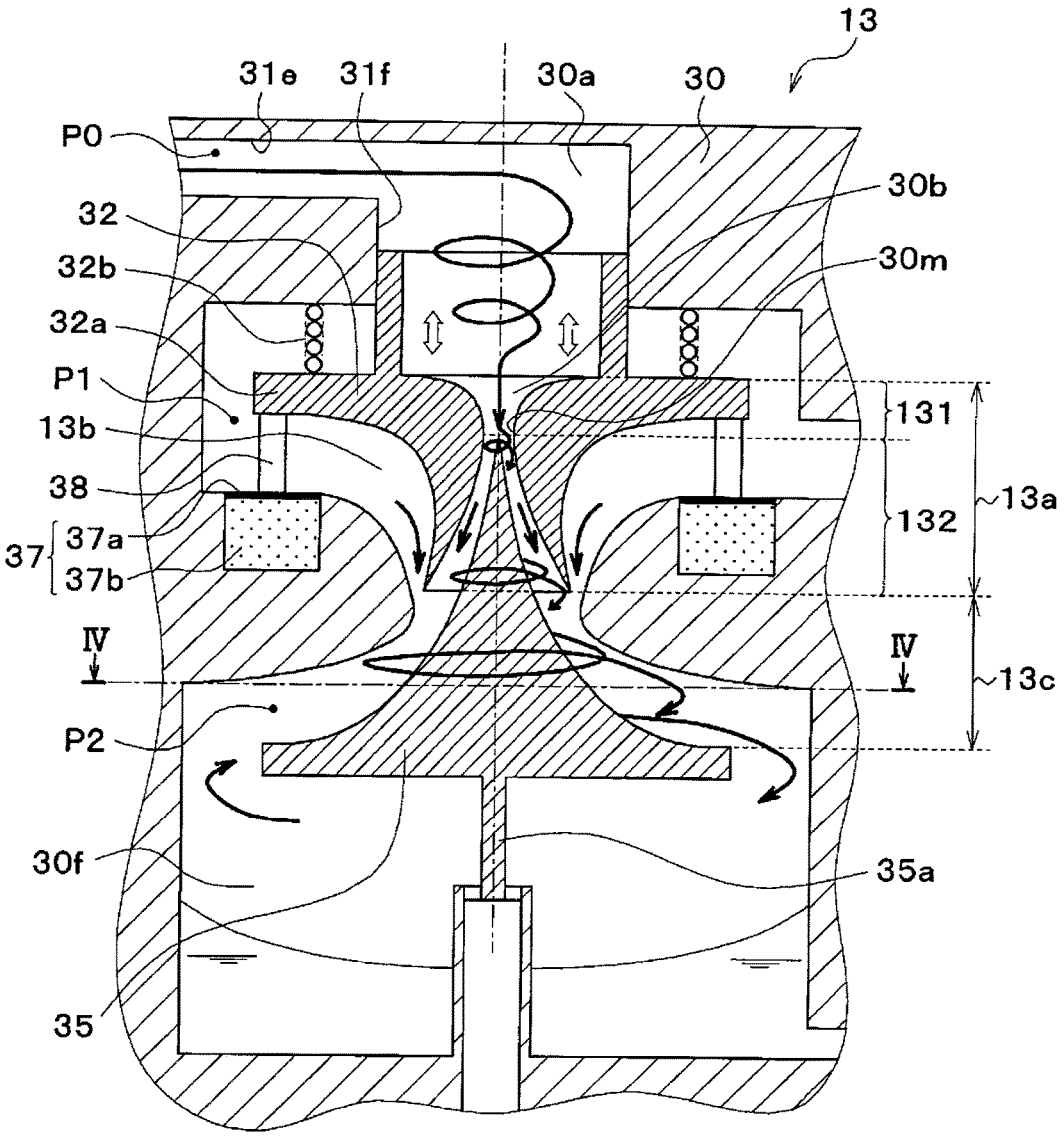
FIG. 3 is a schematic cross-sectional view illustrating respective refrigerant passages of the ejector according to the first embodiment.

First, as illustrated in FIG. 2, the ejector 13 according to this embodiment includes a body part 30 configured by the combination of plural components. Specifically, the body part 30 has a housing body 31 made of prismatic-cylindrical or circular-cylindrical metal, and forming an outer shell of the ejector 13. A nozzle body 32, a middle body 33, and a lower body 34 are housed into or fixed to the housing body 31.

The housing body 31 is formed with the refrigerant inlet port 31*a* through which the refrigerant that has flowed out of the heat radiator 12 flows into the housing body 31, and a refrigerant suction port 31*b* through which the refrigerant that has flowed out of the evaporator 14 is drawn into the housing body 31. The housing body 31 is also formed with a liquid-phase refrigerant outlet port 31*c* through which a liquid-phase refrigerant separated by a gas-liquid separation space 30*f* formed within the body part 30 flows out to the refrigerant inlet side of the evaporator 14, and a gas-phase refrigerant outlet port 31*d* through which the gas-phase refrigerant separated by the gas-liquid separation space 30*f* flows out to the suction side of the compressor 11.

The nozzle body 32 is formed of a metal member having a cylindrical part and a substantially truncated conical part tapered continuously from a lower side of the cylindrical part toward a refrigerant flow direction. The nozzle body 32 is housed in the housing body 31 so that a center axial direction indicated by an alternate long and short dash line in FIG. 2 becomes in parallel to a vertical direction (vertical direction in FIG. 2). Further, the nozzle body 32 is housed to be displaceable in the housing body 31 by the driving force transmitted from a driving device 37 which will be described later.

In more detail, a cylindrical receiving hole 31*f* provided coaxially with the nozzle body 32 is defined in the housing body 31, and an outer peripheral surface of the cylindrical part of the upper side of the nozzle body 32 is slidably fitted into the receiving hole. In other words, an outer diameter of the cylindrical part of the nozzle body 32 and an inner diameter of the receiving hole 31*f* have a dimensional relationship of clearance fit.

With the above configuration, as indicated by outline arrows in FIG. 3, the nozzle body 32 can be displaced within the housing body 31 in the center axial direction. A seal member such as an O-ring (not shown) is disposed in a gap between the outer peripheral side of the cylindrical part of the nozzle body 32 and the inner peripheral side of the receiving hole 31*f*, and the refrigerant does not leak from the gap.

A space defined within the cylindrical part of the nozzle body 32 and a space defined on an upper side of the receiving hole 31*f* of the housing body 31 form a swirling space 30*a* in which the refrigerant flowing from the refrigerant inlet port 31*a* swirls. The swirling space 30*a* is formed in a rotating body shape arranged coaxially with the center axis of the nozzle body 32.

Meanwhile, the rotating body shape is a solid shape formed by rotating a plane figure around one straight line (center axis) coplanar with the plane figure. More specifically, the swirling space 30*a* according to this embodiment is formed into a substantially cylindrical shape. The swirling space 30*a* may be formed in a shape in which a circular cone or a circular truncated cone is combined with a cylinder, or the like.

Further, a refrigerant inlet passage 31*e* that connects the refrigerant inlet port 31*a* and the swirling space 30*a* extends in a tangential direction of an inner wall surface of the swirling space 30*a* when viewed in a center axis direction of the swirling space 30*a*. With this configuration, the refrigerant that has flowed into the swirling space 30*a* from the refrigerant inlet passage 31*e* flows along an inner wall surface of the swirling space 30*a*, and swirls within the swirling space 30*a*.

Meanwhile, the refrigerant inlet passage 31*e* does not need to be formed to completely match the tangential direction of the swirling space 30*a* when viewed in the center axis direction of the swirling space 30*a*. If the refrigerant inlet passage 31*e* includes at least a component in the tangential direction of the swirling space 30*a*, the refrigerant inlet passage 31*e* may be formed to include components in the other directions (for example, components in the axial direction of the swirling space 30*a*).

Since a centrifugal force acts on the refrigerant swirling in the swirling space 30*a*, the pressure of a refrigerant present on the center axis side becomes lower than the pressure of a refrigerant present on the outer peripheral side in the swirling space 30*a*. Accordingly, in this embodiment, during the normal operation of the ejector refrigeration cycle 10, the pressure of a refrigerant present on the center axis side in the swirling space 30*a* is lowered to a pressure at which a liquid-phase refrigerant is saturated or a pressure at which a refrigerant is decompressed and boiled (cavitation occurs).

The adjustment of the pressure of a refrigerant present on the center axis side in the swirling space 30*a* can be realized by adjusting the swirling flow rate of the refrigerant swirling in the swirling space 30*a*. Further, the swirling flow rate can be conducted by, for example, adjusting an area ratio between the passage sectional area of the refrigerant inlet passage 31*e* and the sectional area of the swirling space 30*a* perpendicular to the axial direction. Meanwhile, the swirling flow rate in this embodiment means the flow rate of the refrigerant in the swirling direction in the vicinity of the outermost peripheral part of the swirling space 30*a*.

A depressurizing space 30*b* in which the refrigerant flowing from the swirling space 30*a* is depressurized is formed in a portion of the swirling space 30*a* at a downstream side in the refrigerant flow within the nozzle body 32, that is, within the substantially truncated conical part arranged on the lower side of the nozzle body 32. The depressurizing space 30*b* is formed into a rotating body shape having a cylindrical space coupled with a circular truncated conical space that gradually expands in a refrigerant flow direction continuously from a lower side of the cylindrical space. A center axis of the depressurizing space 30*b* is arranged coaxially with the center axis of the swirling space 30*a*.

Further, a minimum passage area part 30*m* that is most reduced in the refrigerant passage area within the depressurizing space 30*b* is formed, and an upper side of a passage formation member 35 that changes the passage area of the minimum passage area part 30*m* is arranged, within the depressurizing space 30*b*. The passage formation member 35 is formed into a substantially conical shape gradually widened toward the downstream side of the refrigerant flow, and the center axis of the passage formation member 35 is arranged coaxially with the center axis of the depressurizing space 30*b*. In other words, the passage formation member 35 is formed into a conical shape having a cross-sectional area that increases with distance from the depressurizing space 30*b*.

The refrigerant passage is formed between an inner peripheral surface of a portion of the nozzle body 32 which defines the depressurizing space 30*b* and an outer peripheral surface of the upper side of the passage formation member 35. As illustrated in FIG. 3, the refrigerant passage includes a convergent part 131 and a divergent part 132. The convergent part 131 is formed on the upstream side of the minimum passage area part 30*m* in the refrigerant flow, in which the refrigerant passage area extending to the minimum passage area part 30*m* gradually decreases. The divergent part 132 is formed on the downstream side of the minimum passage area part 30*m* in the refrigerant flow, in which the refrigerant passage area gradually increases.

In the divergent part 132, since the depressurizing space 30*b* overlaps (overlaps) with an upper side (apex part side) of the passage formation member 35 when viewed from the radial direction, a sectional shape of the refrigerant passage perpendicular to the axis direction is annular (doughnut shape obtained by removing a smaller-diameter circular shape arranged coaxially from the circular shape). Further, since a spread angle of the passage formation member 35 of this embodiment is smaller than a spread angle of the circular truncated conical space of the depressurizing space 30*b*, the refrigerant passage area of the divergent part 132 gradually enlarges toward the downstream side in the refrigerant flow.

In this embodiment, the refrigerant passage formed between the inner peripheral surface of the depressurizing space 30*b* and the outer peripheral surface of an apex part side of the passage formation member 35 is a nozzle passage 13*a* that functions as a nozzle by the passage shape. The nozzle passage 13*a* depressurizes the refrigerant, and also accelerates the flow rate of the refrigerant to the sonic speed, and jets the refrigerant. Further, since the refrigerant flowing into the nozzle passage 13*a* swirls in the swirling space 30*a*, the refrigerant flowing through the nozzle passage 13*a*, and the ejection refrigerant that is jetted from the nozzle passage 13*a* also have a velocity component in a direction of swirling in the same direction as that of the refrigerant swirling in the swirling space 30*a*.

Next, as illustrated in FIG. 2, the middle body 33 is formed of a disc-shaped member made of metal that is provided with a through-hole of the rotating body shape which penetrates through both sides thereof in the center portion. The middle body 33 accommodates therein the driving device 37 on a radially outer side of the through-hole, and the driving device 37 displaces the nozzle body 32. Meanwhile, a center axis of the through-hole is arranged coaxially with the center axes of the swirling space 30*a* and the depressurization space 30*b*. Also, the middle body 33 is fixed to the interior of the housing body 31 and the lower side of the nozzle body 32 by means such as press fitting.

Further, an inflow space 30*c* is formed between an upper surface of the middle body 33 and an inner wall surface of the housing body 31 facing the middle body 33, and the inflow space 30*c* accumulates the refrigerant that has flowed out of the refrigerant suction port 31*b*. Meanwhile, in this embodiment, a leading tip of the substantially truncated conical part on the lower side of the nozzle body 32 is located within the through-hole of the middle body 33. Therefore, a cross-section surface of the inflow space 30*c* perpendicular to the axial direction thereof has an annular shape (donut shape).

The through-hole of the middle body 33 has a part in which a refrigerant passage area is gradually reduced toward the refrigerant flow direction so as to match an outer peripheral shape of the tapered tip of the nozzle body 32 in an area where the lower side of the nozzle body 32 is inserted, that is, an area in which the middle body 33 and the nozzle body 32 overlap with each other when viewed in a radial direction perpendicular to the axis line.

Accordingly, a suction passage 30*d* is formed between an inner peripheral surface of the through-hole and an outer peripheral surface of a nearly truncated cone-shaped portion of the nozzle body 32, and the inflow space 30*c* communicates with a downstream side of the depressurizing space 30*b* in the refrigerant flow through the suction passage 30*d*. That is, in this embodiment, the inflow space 30*c* and the suction passage 30*d* configure a suction passage 13*b* through which the suction refrigerant flows from the radially outer side toward the radially inner side with respect to the center axis. Further, a cross-section surface of the suction passage 13*b* perpendicular to the axial direction also has an annular shape.

Also, a pressurizing space 30*e* formed into a substantially circular truncated conical shape that gradually spreads in the refrigerant flow direction is formed in the through-hole of the middle body 33 on the downstream side of the suction passage 30*d* in the refrigerant flow. The pressurizing space 30*e* is a space in which the ejection refrigerant ejected from the above-mentioned nozzle passage 13*a* is mixed with the suction refrigerant drawn from the suction passage 30*d*.

The lower side of the above-mentioned passage formation member 35 is located in the pressurizing space 30*e*. Further, a spread angle of the conical-shaped side surface of the passage formation member 35 in the pressurizing space 30*e* is smaller than a spread angle of the circular truncated conical space of the pressurizing space 30*e*. Therefore, the refrigerant passage area of the refrigerant passage is gradually enlarged toward the downstream side in the refrigerant flow.

In this embodiment, the refrigerant passage area is enlarged as above. Thus, the refrigerant passage, which is formed between the inner peripheral surface of the middle body 33 and the outer peripheral surface of the lower side of the passage formation member 35 and configures the pressurizing space 30*e*, is defined as a diffuser passage 13*c* which functions as a diffuser. The diffuser passage 13*c* converts velocity energies of a mixture of the ejection refrigerant and the suction refrigerant into a pressure energy. That is, in the diffuser passage 13*c*, the ejection refrigerant and the suction refrigerant are mixed together, and pressurized.

Figure 4:
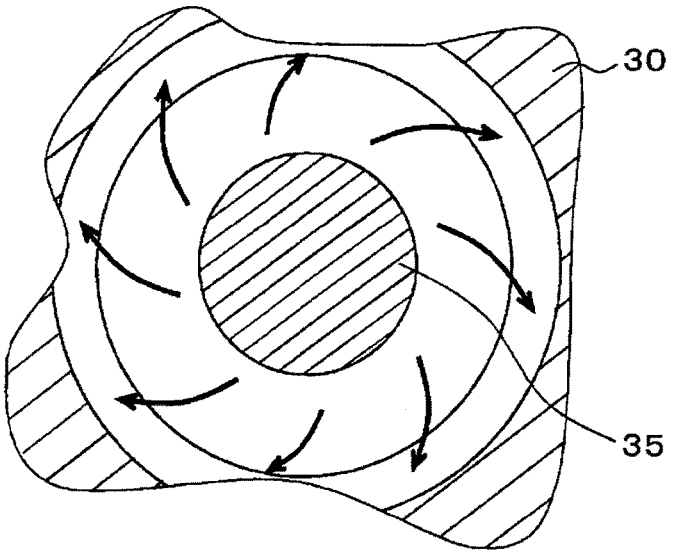
FIG. 4 is a cross-sectional view taken along a line IV-IV of FIG. 3.

Further, as illustrated in a cross-sectional view of FIG. 4, a cross-section of the diffuser passage 13*c* perpendicular to the axial direction also has an annular shape. As schematically illustrated in FIGS. 3 and 4, the refrigerant that flows through the diffuser passage 13*c* also has a velocity component in a direction of swirling in the same direction as that of the refrigerant swirling in the swirling space 30*a*.

Next, the driving device 37 that is arranged within the middle body 33 and displaces the nozzle body 32 will be described. The driving device 37 includes a circular thin plate-like diaphragm 37*a* which is an example of a pressure responding member, and a sealed space 37*b* that is defined by the diaphragm 37*a*. The diaphragm 37*a* is fixed by means such as welding so as to seal an opening portion of the upper side (inflow space 30*c* side) of a columnar bottomed hole which is defined in the middle body 33.

Further, a space defined by allowing the diaphragm 37*a* to seal the columnar bottomed hole of the middle body 33 configures the sealed space 37*b* in which a temperature sensitive medium is enclosed. A pressure of the temperature sensitive medium changes according to a temperature of the refrigerant flowing out of the evaporator 14. The temperature sensitive medium, which has the same composition as that of a refrigerant flowing in the ejector refrigeration cycle 10, is enclosed in the sealed space 37*b* so as to have a predetermined density. Accordingly, the temperature sensitive medium of this embodiment is R134a or a medium mainly containing R134a.

As is apparent from FIG. 2, the diaphragm 37*a* and the sealed space 37*b* configuring the driving device 37 are arranged on the outer peripheral side in the middle body 33, that is, on the outer peripheral side of the passage formation member 35. The inflow space 30*c* forming the suction passage 13*b* is arranged on the upper side of the middle body 33, and the diffuser passage 13*c* is arranged on the lower side of the middle body 33.

Therefore, at least a part of the driving device 37 is arranged at a position sandwiched by the suction passage 13*b* and the diffuser passage 13*c* from the vertical direction when viewed from the radial direction of the axis line. In other words, the driving device 37 is arranged between the suction passage 13*b* and the diffuser passage 13*c* at a position where the suction passage 13*b* overlaps with the diffuser passage 13*c* when viewed from the center axial direction of the passage formation member 35.

A temperature of the refrigerant flowing out of the evaporator 14, which has flowed into the inflow space 30*c*, is transmitted to the temperature sensitive medium in the sealed space 37*b* through the diaphragm 37*a* and the middle body 33. Therefore, an internal pressure in the sealed space 37*b* becomes a pressure corresponding to the temperature of the refrigerant flowing out of the evaporator 14. Then, the diaphragm 37*a* is deformed according to a differential pressure between the internal pressure in the sealed space 37*b* and the pressure of the refrigerant flowing into the inflow space 30*c* out of the evaporator 14.

For that reason, it is preferable that the diaphragm 37*a* is made of a material rich in elasticity, excellent in heat conduction, and tough. For example, it is preferable that the diaphragm 37*a* is formed of a metal laminate made of stainless steel (SUS304).

Further, a lower end of a columnar actuating bar 38 extending in the vertical direction is joined to a center portion of a side surface of the inflow space 30*c* of the diaphragm 37*a* by joining means such as welding. On the other hand, a disk-shaped flange part 32*a* is fixed to an upper end of the actuating bar 38. The flange part 32*a* is disposed on the outer peripheral side of the nozzle body 32, and spreads on the outer peripheral side.

With this configuration, the diaphragm 37*a* and the nozzle body 32 are coupled with each other, and the nozzle body 32 is displaced in accordance with a displacement of the diaphragm 37*a* to regulate the refrigerant passage area of the nozzle portion 13*a* (passage cross-sectional area in the minimum passage area part 30*m*). In other words, the actuating bar 38 according to this embodiment functions as an example of the coupling member that couples the diaphragm 37*a* configuring the driving device 37 with the nozzle body 32, and transmits the driving force from the driving device 37 to the nozzle body 32.

A coil spring 32*b* is arranged between the flange part 32*a* of the nozzle body 32 and the housing body 31. The coil spring 32*b* applies a load to the nozzle body 32. The load is urged against a side coming closer to the passage formation member 35 (a side reducing the refrigerant passage area in the minimum passage area part 30*m*).

Therefore, when a temperature (the degree of superheat) of the refrigerant flowing into the inflow space 30*c* out of the evaporator 14 rises, a saturated pressure of the temperature sensitive medium enclosed in the sealed space 37*b* rises, and a differential pressure obtained by the refrigerant pressure within the inflow space 30*c* is subtracted from the internal pressure in the sealed space 37*b* becomes large. Then, when a load caused by the differential pressure exceeds a load caused by the coil spring 32*b*, the diaphragm 37*a* is displaced to the inflow space 30*c* (suction passage 13*b*) side.

Further, the displacement of the diaphragm 37*a* to the inflow space 30*c* side is transmitted to the nozzle body 32 through the actuating bar 38 with the results that the nozzle body 32 is displaced to the upper side (a side increasing the refrigerant passage area in the minimum passage area part 30*m*).

On the other hand, when the temperature (the degree of superheat) of the refrigerant flowing into the inflow space 30*c* out of the evaporator 14 falls, a saturated pressure of the temperature sensitive medium sealed in the sealed space 37*b* falls to decrease the differential pressure obtained by subtracting the refrigerant pressure in the inflow space 30*c* from the internal pressure of the sealed space 37*b*. Then, when the load caused by the differential pressure becomes smaller, the diaphragm 37*a* is displaced to the sealed space 37*b* (diffuser passage 13*c*) side due to the load caused by the coil spring 32*b*.

Further, the displacement of the diaphragm 37*a* to the sealed space 37*b* side is transmitted to the nozzle body 32 through the actuating bar 38 with the results that the nozzle body 32 is displaced to the lower side (a side decreasing the refrigerant passage area in the minimum passage area part 30*m*).

That is, in the driving device 37 according to this embodiment, a force (driving force) directed from the diffuser passage 13*c* side to the suction passage 13*b* side in the axial direction (vertical direction) of the passage formation member 35 is generated to increase the refrigerant passage area in the minimum passage area part 30*m* of the nozzle passage 13*a*.

As described above, the nozzle body 32 displaces the driving device 37 (diaphragm 37*a*) according to the degree of superheat of the refrigerant flowing out or the evaporator 14. As a result, the refrigerant passage area in the minimum passage area part 30*m* can be regulated so that the degree of superheat of the refrigerant on the outlet side of the evaporator 14 approaches a predetermined given value. Further, the amount of displacement of the nozzle body 32 is changed by regulating the load of the coil spring 32*b*, thereby being capable of changing the intended degree of superheat.

Further, in this embodiment, the multiple (specifically, two) cylindrical spaces are provided in the part of the middle body 33 on the radially outer side, and the respective circular laminated diaphragms 37*a* are fixed in those spaces to configure two driving devices 37. However, the number of driving devices 37 is not limited to this number. When the driving devices 37 are provided at plural locations, it is preferable that the driving devices 37 are arranged at regular angular intervals with respect to the center axes.

Alternatively, a diaphragm formed of the annular thin plate may be fixed in a space having an annular shape when viewed from the axial direction, and the diaphragm and the passage formation member 35 may be coupled with each other by multiple actuating bars.

Next, the lower body 34 illustrated in FIG. 2 is formed of a circular-cylindrical metal member, and fixed in the housing body 31 by means such as screwing so as to close a bottom of the housing body 31. The gas-liquid separation space 30*f* that separates gas and liquid of the refrigerant that has flowed out of the diffuser passage 13*c* from each other is formed between the upper side of the lower body 34 and the middle body 33.

The gas-liquid separation space 30*f* is formed as a space of a substantially cylindrical rotating body shape, and the center axis of the gas-liquid separation space 30*f* is also arranged coaxially with the center axes of the swirling space 30*a* and the depressurization space 30*b*.

As described above, the refrigerant flows in the diffuser passage 13*c* along the refrigerant passage having an annular shape in cross-section while swirling. Therefore, the refrigerant that flows from the diffuser passage 13*c* into the gas-liquid separation space 30*f* also has a velocity component in the swirling direction. Therefore, the gas and liquid of refrigerant are separated by the action of the centrifugal force within the gas-liquid separation space 30*f*. In addition, an internal capacity of the gas-liquid separation space 30*f* has a volume insufficient to substantially accumulate excess refrigerant even if a load variation occurs in the cycle, and the refrigerant circulation flow rate circulating in the cycle is varied.

A cylindrical pipe 34*a* that is arranged coaxially with the gas-liquid separation space 30*f* and extends upward is disposed in the center part of the lower body 34. The liquid-phase refrigerant separated by the gas-liquid separation space 30*f* is temporarily retained on the outer peripheral side of the pipe 34*a*, and flows out of the liquid-phase refrigerant outlet port 31*c*. Also, a gas-phase refrigerant outflow passage 34*b* is formed inside the pipe 34*a* and guides the gas-phase refrigerant separated in the gas-liquid separation space 30*f* to the gas-phase refrigerant outlet port 31*d* of the housing body 31.

Further, a plate member 35*a* having multiple communication holes communicating front and rear sides of an upper end of the pipe 34*a* with each other is arranged on the upper end of the pipe 34*a*. A substantially columnar coupling post 35*b* is fixed to the plate member 35*a*. The coupling post 35*b* is disposed on a bottom of the passage formation member 35, and formed to be thinner than the gas-phase refrigerant outflow passage 34*b*. An oil return hole 34*d* is defined in a root part (lowermost part) of the pipe 34*a*. The oil return hole 34*d* is configured to return a refrigerator oil mixed in the liquid-phase refrigerant into the compressor 11 through the gas-phase refrigerant outflow passage 34*b*.

The liquid-phase refrigerant outlet port 31*c* of the ejector 13 is connected with an inlet side of the evaporator 14 as illustrated in FIG. 1. The evaporator 14 is a heat exchanger for absorbing heat that evaporates a low-pressure refrigerant depressurized by the ejector 13 and performs a heat absorbing action by exchanging heat between the low-pressure refrigerant and blast air that is blown into the vehicle interior from a blower fan 14*a*.

The blower fan 14*a* is an electric blower of which the rotation speed (the amount of blast air) is controlled by a control voltage output from the control device. An outlet side of the evaporator 14 is connected with the refrigerant suction port 31*b* of the ejector 13. Further, the gas-phase refrigerant outlet port 31*d* of the ejector 13 is connected with the suction side of the compressor 11.

Next, the control device (not shown) includes a well-known microcomputer including a CPU, a ROM and a RAM, and peripheral circuits of the microcomputer. The control device controls the operations of the above-mentioned various electric actuators 11*b*, 12*d*, 14*a* and the like by performing various calculations and processing on the basis of a control program stored in the ROM.

Further, a sensor group for controlling air conditioning, such as an inside air-temperature sensor for detecting a vehicle interior temperature, an outside air-temperature sensor for detecting the temperature of outside air, a solar radiation sensor for detecting the quantity of solar radiation in the vehicle interior, an evaporator-temperature sensor for detecting the blow-out air temperature from the evaporator 14 (the temperature of the evaporator), an outlet-side temperature sensor for detecting the temperature of a refrigerant on the outlet side of the heat radiator 12, and an outlet-side pressure sensor for detecting the pressure of a refrigerant on the outlet side of the heat radiator 12, is connected to the control device. Accordingly, detection values of the sensor group are input to the control device.

Furthermore, an operation panel (not shown), which is disposed near a dashboard panel positioned at the front part in the vehicle interior, is connected to the input side of the control device, and operation signals output from various operation switches mounted on the operation panel are input to the control device. An air conditioning operation switch that is used to perform air conditioning in the vehicle interior, a vehicle interior temperature setting switch that is used to set the temperature of the vehicle interior, and the like are provided as the various operation switches that are mounted on the operation panel.

Meanwhile, the control device of this embodiment is integrated with control means for controlling the operations of various control target devices connected to the output side of the control device, but structure (hardware and software), which controls the operations of the respective control target devices, of the control device forms control means of the respective control target devices. For example, structure (hardware and software), which controls the operation of the electric motor 11*b* of the compressor 11, forms discharge capability control means in this embodiment.

Next, the operation of this embodiment having the above-mentioned configuration will be described with reference to a Mollier diagram of FIG. 5. The axis of ordinate in the Mollier diagram represents a pressure corresponding to P0, P1, and P2 in FIG. 3. First, when an operation switch of the operation panel is turned on, the control device operates the electric motor 11*b* of the compressor 11, the cooling fan 12*d*, the blower fan 14*a*, and the like. Accordingly, the compressor 11 draws and compresses a refrigerant and discharges the refrigerant.

The gas-phase refrigerant (point a5 in FIG. 5), which is discharged from the compressor 11 and has a high temperature and a high pressure, flows into the condenser 12*a* of the heat radiator 12 and is condensed by exchanging heat between the blast air (outside air), which is blown from the cooling fan 12*d*, and itself and by radiating heat. The refrigerant, which has radiated heat in the condenser 12*a*, is separated into gas and liquid in the receiver part 12*b*. A liquid-phase refrigerant, which has been subjected to gas-liquid separation in the receiver part 12*b*, is changed into a subcooled liquid phase refrigerant by exchanging heat between the blast air, which is blown from the cooling fan 12*d*, and itself in the subcooling portion 12*c* and further radiating heat (from point a5 to point b5 in FIG. 5).

Figure 5:
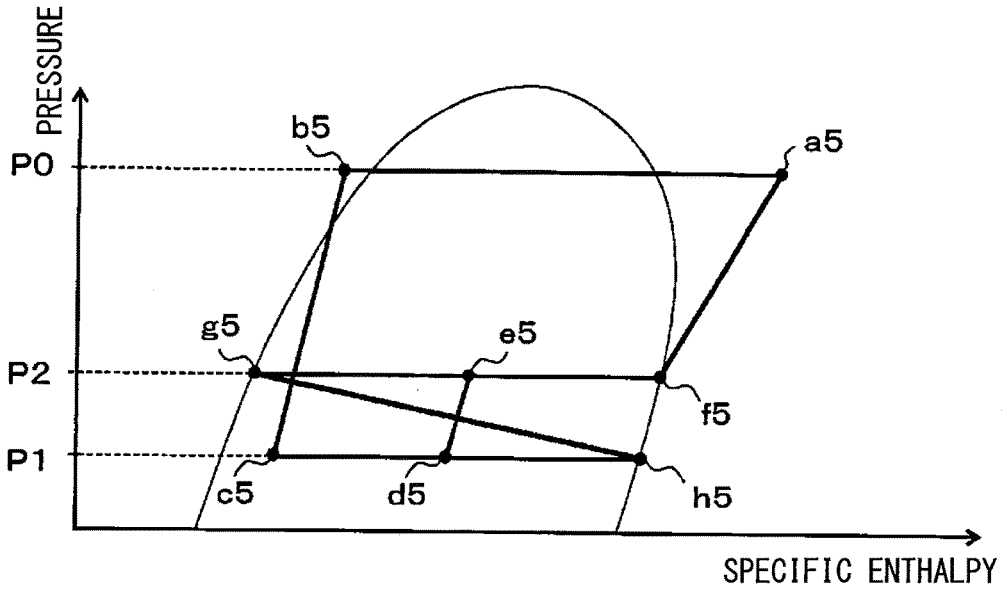
FIG. 5 is a Mollier diagram illustrating a state of the refrigerant in the ejector refrigeration cycle according to the first embodiment.

The subcooled liquid-phase refrigerant that has flowed out of the subcooling portion 12*c* of the heat radiator 12 is isentropically depressurized by the nozzle passage 13*a*, and ejected (from point b5 to point c5 in FIG. 5). The nozzle passage 13*a* is formed between the inner peripheral surface of the depressurization space 30*b* of the ejector 13 and the outer peripheral surface of the passage formation member 35. In this situation, the refrigerant passage area in the minimum passage area part 30*m* of the depressurization space 30*b* is regulated so that the degree of superheating of the refrigerant on the outlet side of the evaporator 14 comes close to a predetermined given value.

The refrigerant that has flowed out of the evaporator 14 is drawn through the refrigerant suction port 31*b* and the suction passage 13*b* (the inflow space 30*c*, and the suction passage 30*d*) due to the suction action of the ejection refrigerant which has been jetted from the nozzle passage 13*a*. In addition, the ejection refrigerant jetted from the nozzle passage 13*a* and the suction refrigerant drawn through the suction passage 13*b* and the like flow into the diffuser passage 13*c* (from point c5 to point d5, and from point h5 to point d5 in FIG. 5).

In the diffuser passage 13*c*, the velocity energy of the refrigerant is converted into the pressure energy due to the enlarged refrigerant passage area. As a result, the mixed refrigerant is pressurized while the ejection refrigerant and the suction refrigerant are mixed together (from point d5 to point e5 in FIG. 5). The refrigerant that has flowed out of the diffuser passage 13*c* is separated into gas and liquid in the gas-liquid separation space 30*f* (from point e5 to point f5, and from point e5 to point g5 in FIG. 5).

The liquid-phase refrigerant that has been separated in the gas-liquid separation space 30*f* flows out of the liquid-phase refrigerant outlet port 31*c*, and flows into the evaporator 14. The refrigerant having flowed into the evaporator 14 absorbs heat from the blast air blown by the blower fan 14*a*, and evaporates, and the blast air is cooled (point g5 to point h5 in FIG. 5). On the other hand, the gas-phase refrigerant that has been separated in the gas-liquid separation space 30*f* flows out of the gas-phase refrigerant outlet port 31*d*, and is drawn into the compressor 11 and compressed again (point f5 to point a5 in FIG. 5).

The ejector refrigeration cycle 10 according to this embodiment operates as described above, and can cool the blast air to be blown into the vehicle interior. Further, in the ejector refrigeration cycle 10, since the refrigerant pressurized by the diffuser passage 13*c* is drawn into the compressor 11, the drive power of the compressor 11 can be reduced to improve the cycle of performance (COP).

Further, according to the ejector 13 of this embodiment, the refrigerant swirls in the swirling space 30*a* with the results that a refrigerant pressure on a swirling center side in the swirling space 30*a* can be reduced to a pressure of a saturated liquid-phase refrigerant, or a pressure at which the refrigerant is depressurized and boiled (cavitation occurs). With the above operation, a larger amount of gas-phase refrigerant is present on an inner peripheral side than an outer peripheral side of a swirling center axis. This leads to a two-phase separation state in which the refrigerant has a gas single phase in the vicinity of a swirling center line within the swirling space 30*a*, and has a liquid single phase around the vicinity thereof.

The refrigerant that has become in the two-phase separation state as described above flows into the nozzle passage 13*a*. As a result, in the convergent part 131 of the nozzle passage 13*a*, boiling of the refrigerant is promoted by the wall surface boiling generated when the refrigerant is separated from the outer peripheral side wall surface of the annular refrigerant passage, and the interface boiling caused by a boiling nuclear generated by the cavitation of the refrigerant on the center axis side of the annular refrigerant passage. Accordingly, the refrigerant that flows into the minimum passage area part 30*m* of the nozzle passage 13*a* becomes in a gas-liquid mixed state in which the gas phase and the liquid phase are uniformly mixed together.

The flow of the refrigerant in the gas-liquid mixed state is blocked (choked) in the vicinity of the minimum passage area part 30*m*. The refrigerant in the gas-liquid mixed state which reaches the sonic speed by the choking is accelerated in the divergent part 132, and ejected. As described above, the refrigerant of the gas-liquid mixed state can be efficiently accelerated to the sonic speed by the boiling promotion caused by both of the wall surface boiling and the interface boiling. As a result, the energy conversion efficiency (corresponding to the nozzle efficiency) in the nozzle passage 13*a* can be improved.

In addition, the ejector 13 of this embodiment employs the passage formation member 35 having a conical shape in which a cross-sectional area increases with distance from the depressurizing space 30*b*. The cross-sectional shape of the diffuser passage 13*c* is formed in an annular shape. Therefore, the diffuser passage 13*c* can be made to have a shape to expand along the outer periphery of the passage formation member 35 with distance from the depressurizing space 30*b*, and the refrigerant flowing through the diffuser passage 13*c* can be swirled.

With the above configuration, since the refrigerant flow channel for pressurizing the refrigerant can be formed into the spiral shape in the diffuser passage 13*c*, enlargement of the dimension of the diffuser passage 13*c* in the axial direction (the axial direction of the passage formation member 35) can be limited as compared with a case in which the diffuser portion is shaped to extend in the axial direction of the nozzle portion. As a result, the upsizing of the body of the overall ejector 13 can be restricted.

Further, in the ejector 13 according to this embodiment, since the driving device 37 is provided, the nozzle body 32 can be displaced in accordance with a load variation of the ejector refrigeration cycle 10 to regulate the refrigerant passage area (passage cross-sectional area in the minimum passage area part 30*m*) of the nozzle passage 13*a*. Therefore, the ejector 13 can appropriately operate according to the load variation of the ejector refrigeration cycle 10.

In addition, in the ejector 13 according to this embodiment, since the driving device 37 does not displace the passage formation member 35, but displaces the nozzle body 32 for changing the refrigerant passage area of the nozzle passage 13*a*, a configuration that does not interfere the swirling flow of the refrigerant flowing through the diffuser passage 13*c* can be easily realized as a configuration in which the driving force is transmitted from the driving device 37 to the nozzle body 32.

In other words, the configuration in which the velocity of the refrigerant flowing through the diffuser passage 13*c* in the swirling direction is not reduced can be easily realized as the configuration in which the driving force is transmitted from the driving device 37 to the nozzle body 32. Therefore, a reduction in the spiral refrigerant flow channel for pressurizing the refrigerant in the diffuser passage 13*c* is restricted, thereby being capable of suppressing a reduction in the pressurizing amount of refrigerant in the diffuser passage 13*c*. Further, a reduction in the centrifugal force acting on the refrigerant which has flowed out of the diffuser passage 13*c*, and flowed into the gas-liquid separation space 30*f* can be restricted. Also, a reduction in the gas-liquid separation performance in the gas-liquid separation space 30*f* can be restricted.

Specifically, in this embodiment, the driving device 37 is arranged at a position sandwiched between the suction passage 13*b* and the diffuser passage 13*c* vertically on the outer peripheral side of the passage formation member 35, and the actuating bar 38 as the coupling member is arranged to extend from the driving device 37 to the suction passage 13*b* side. The driving force generated by the driving device 37 is transmitted to the upper side of the driving device 37.

As a result, the driving force generated by the driving device 37 for displacing the nozzle body 32 is transmitted toward an apex side (upward) of the passage formation member 35 in the axial direction. Therefore, as illustrated in a cross-sectional view of FIG. 4, a configuration in which the actuating bar 38 does not cross the diffuser passage 13*c* and the vicinity of an inlet and an outlet of the diffuser passage 13*c* can be realized, and a configuration in which the velocity of the refrigerant flowing through the diffuser passage 13*c* in the swirling direction is not reduced can be extremely easily realized.

In other words, a configuration in which the actuating bar 38 is arranged outside of the diffuser passage 13*c* so as not to block a flow of the refrigerant flowing through the diffuser passage 13*c* can be realized, and a configuration in which the velocity of the refrigerant flowing through the diffuser passage 13*c* in the swirling direction is not reduced can be extremely easily realized. Therefore, since the actuating bar 38 does not produce a passage resistance of the refrigerant flowing through the diffuser passage 13*c*, a reduction in the amount of pressurizing the refrigerant in the diffuser passage 13*c* can be suppressed.

As a result, according to the ejector 13 of this embodiment, the high energy conversion efficiency (corresponding to the nozzle efficiency) can be achieved in the nozzle passage 13*a* regardless of the load variations of the ejector refrigeration cycle 10 without upsizing the body. Further, the high pressurizing performance can be performed by the diffuser passage 13*c*.

In the ejector 13 of this embodiment, since the driving device 37 is arranged at a position sandwiched between the suction passage 13*b* and the diffuser passage 13*c* vertically, a space defined between the suction passage 13*b* and the diffuser passage 13*c* can be effectively utilized. As a result, the body as the overall ejector can be further restricted from being upsized.

Moreover, since the sealed space 37*b* is arranged at the position surrounded by the suction passage 13*b* and the diffuser passage 13*c*, the temperature of the refrigerant flowing out of the evaporator 14 is excellently transmitted to the temperature sensitive medium without being affected by an outside air temperature, and the pressure in the sealed space 37*b* can be changed accordingly. That is, the pressure within the sealed space 37*b* can be changed with high precision depending on the temperature of the refrigerant out of the evaporator 14.

As a result, the refrigerant passage area (passage cross-sectional area in the minimum passage area part 30*m*) of the nozzle passage 13*a* can be more appropriately changed, and the driving device 37 can be downsized with a reduction in the size of the sealed space 37*b*.

Also, the gas-liquid separation space 30*f* that separates gas and liquid of the refrigerant that has flowed out of the diffuser passage 13*c* is formed in the body part 30 of the ejector 13 according to this embodiment. Hence, the capacity of the gas-liquid separation space 30*f* can be effectively reduced as compared with a case in which gas-liquid separating means is provided in addition to the ejector 13.

That is, in the gas-liquid separation space 30*f* according to this embodiment, since the refrigerant that flows out of the diffuser passage 13*c* has been already swirled, there is no need to provide a space for generating or growing the swirling flow of the refrigerant in the gas-liquid separation space 30*f*. Therefore, the capacity of the gas-liquid separation space 30*f* can be effectively reduced as compared with the case in which the gas-liquid separating means is provided apart from the ejector 13.

Second Embodiment

Figure 6:
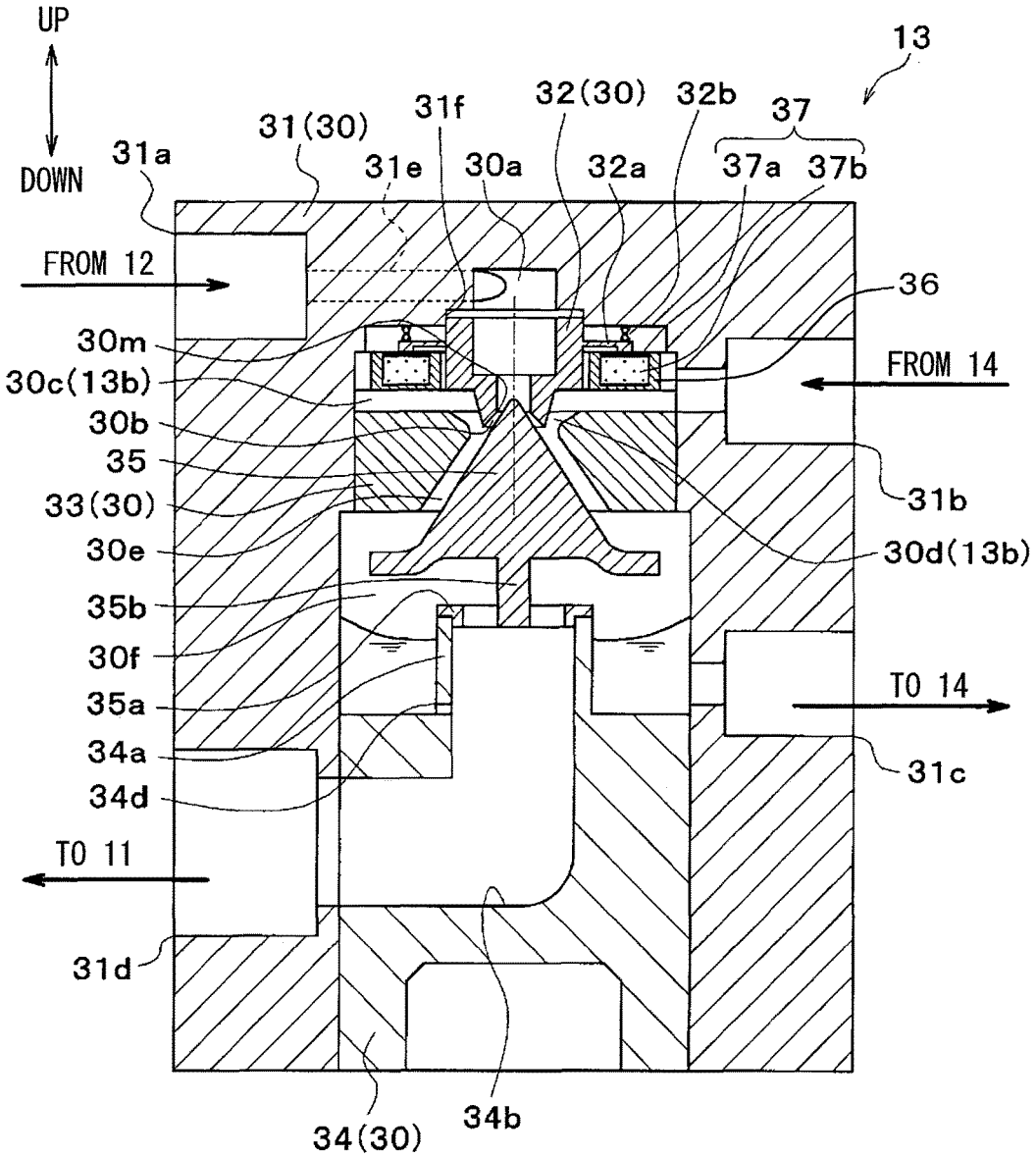
FIG. 6 is a sectional view taken along an axial direction of an ejector according to a second embodiment of the present disclosure.

In this embodiment, a description will be given of an example in which the arrangement mode of the driving device 37 is changed as illustrated in FIG. 6 in the first embodiment. Meanwhile, FIG. 6 is a cross-sectional view corresponding to FIG. 2 in the first embodiment, and the same portions as or the equivalent portions to the portions of the first embodiment are denoted by the same reference numerals.

Specifically, the driving device 37 according to this embodiment is arranged inside of an auxiliary plate 36 (fixed plate). The auxiliary plate 36 is formed of a disc-shaped member made of metal that is provided with a columnar through-hole which penetrates through both sides thereof in the center portion. The auxiliary plate 36 accommodates therein a driving device 37 having the same configuration as that in the first embodiment on a radially outer side of the through-hole.

A center axis of the through-hole in the auxiliary plate 36 is arranged coaxially with the center axis of the nozzle body 32, and a cylindrical part of the nozzle body 32 is arranged on an inner peripheral side of the through-hole. An outer peripheral side of the auxiliary plate 36 is fixed to the inside of the housing body 31 by means such as press fitting or screwing. In other words, the auxiliary plate 36 is arranged in the inflow space 30*c* on the outer peripheral side of the cylindrical part of the nozzle body 32.

For that reason, as illustrated in FIG. 6, the diaphragm 37*a* and the flange part 32*a* of the nozzle body 32 which are arranged on an upper surface side of the auxiliary plate 36 can be arranged close to each other, and the diaphragm 37*a* and the flange part 32*a* can be coupled with each other through a short coupling member (actuating bar). It is needless to say that the diaphragm 37*a* and the flange part 32*a* may be coupled directly with each other without the provision of the coupling member.

In addition to the through-hole in the center part, multiple through-holes that penetrate through both sides of the auxiliary plate 36 are defined in the auxiliary plate 36. A space on the front surface (upper surface) side of the disk-shaped auxiliary plate 36 and a space on the rear surface (bottom surface) side thereof communicate with each other through the through-holes. Therefore, the temperature of the refrigerant flowing into the inflow space 30*c* from the evaporator 14 can be efficiently transmitted to the temperature sensitive medium within the sealed space 37*b* from both sides of the upper surface side and the bottom surface side of the auxiliary plate 36.

Other structures and operations are the same as those of the first embodiment. Therefore, also in the ejector 13 according to this embodiment, the configuration that does not block the swirling flow of the refrigerant flowing through the diffuser passage 13*c* can be extremely easily realized as the configuration that transmits the driving force from the driving device 37 to the nozzle body 32. The same advantages as those in the first embodiment can be obtained.

Further, in this embodiment, since the driving device 37 is not arranged in the middle body 33, the design freedom of the middle body 33 and the passage formation member 35 can be improved. For example, a spread angle of the diffuser passage 13*c* defined between the inner peripheral side of the middle body 33 and the outer peripheral side of the passage formation member 35 increases, and a dimension of the overall ejector 13 in the axial direction can be shortened.

The present disclosure is not limited to the above-mentioned embodiments, and may have various modifications as described below without departing from the gist of the present disclosure.

(1) In the above embodiments, the description has been given of the example in which the driving device 37 that displaces the nozzle body 32 includes the sealed space 37*b* in which the temperature sensitive medium having the pressure changed according to a change in the temperature is sealed, and the diaphragm 37*a* that is displaced according to the pressure of the temperature sensitive medium within the sealed space 37*b*. However, the driving device is not limited to this configuration.

For example, a thermowax having a volume changed according to the temperature may be employed as the temperature sensitive medium, or a configuration having an elastic member of a shape memory alloy may be used as the driving device. Further, a configuration in which the passage formation member 35 may be displaced by an electric mechanism such as an electric motor or a solenoid may be employed as the driving device.

Further, in the above-mentioned first embodiment, the driving device 37 is arranged on the outer peripheral side of the passage formation member 35 with the arrangement of the driving device 37 inside of the middle body 33. In the second embodiment, the driving device 37 is arranged on the outer peripheral side of the nozzle body 32 with the arrangement of the driving device 37 inside of the auxiliary plate 36. However, the arrangement of the driving device 37 is not limited to this example. For example, the driving device 37 may be arranged on an upper side (swirling space 30*a* side) outside of the body part 30.

(2) In the above embodiments, the details of the liquid-phase refrigerant outlet port 31*c* and the gas-phase refrigerant outlet port 31*d* of the ejector 13 are not described. Depressurizing means (for example, side fixed aperture orifice or a capillary tube) for depressurizing the refrigerant may be arranged on those refrigerant outlet ports. For example, a fixed aperture may be added to the liquid-phase refrigerant outlet port 31*c*, and the ejector 13 may be applied to an ejector refrigeration cycle of a two-stage pressurizing type compressor.

(3) In the above embodiments, the example in which the nozzle body 32 is made of metal has been described. Specifically, aluminum can be employed. Further, the nozzle body 32 may be made of resin. For example, when the nozzle body 32 is made of resin, and reduced in weight, the driving device 37 can be downsized, and the body of the overall ejector 13 can be further downsized.

(4) In the above embodiments, the example in which the ejector refrigeration cycle 10 including the ejector 13 of the present disclosure is applied to a vehicle air conditioning apparatus has been described, but the application of the refrigeration cycle device having the ejector 13 of the present disclosure is not limited to this configuration. The ejector refrigeration cycle 10 may be applied to, for example, a stationary air conditioning apparatus, a cold storage warehouse, a cooling heating device for a vending machine, etc.

(5) In the above embodiments, the example in which the gas-liquid separation space 30*f* is configured inside of the body part 30 of the ejector 13 has been described. Alternatively, the gas-liquid separation space 30*f* may be eliminated, and a gas-liquid separator that separates the refrigerant flowing out of the diffuser passage 13*c* into gas and liquid may be arranged outside of the ejector 13. In the above embodiments, the example in which a subcooling heat exchanger is employed as the heat radiator 12 for the purpose of allowing the subcooled liquid-phase refrigerant to effectively flow into the swirling space 30*a* has been described. Alternatively, a normal heat radiator formed of only the condenser 12*a* may be employed.

(6) In the above embodiments, the example in which the actuating bar 38 is arranged without crossing the diffuser passage 13*c* whereby the velocity of the refrigerant flowing through the diffuser passage 13*c* is not reduced has been described. However, depending on the operating conditions of the ejector refrigeration cycle 10, as indicated by thick solid lines in FIG. 7, in the velocity components of the refrigerant flowing through the diffuser passage 13*c*, a velocity component in the swirling direction may become sufficiently small, or the velocity component in the swirling direction may be almost eliminated as compared with a velocity component in the axial direction.

Figure 7:
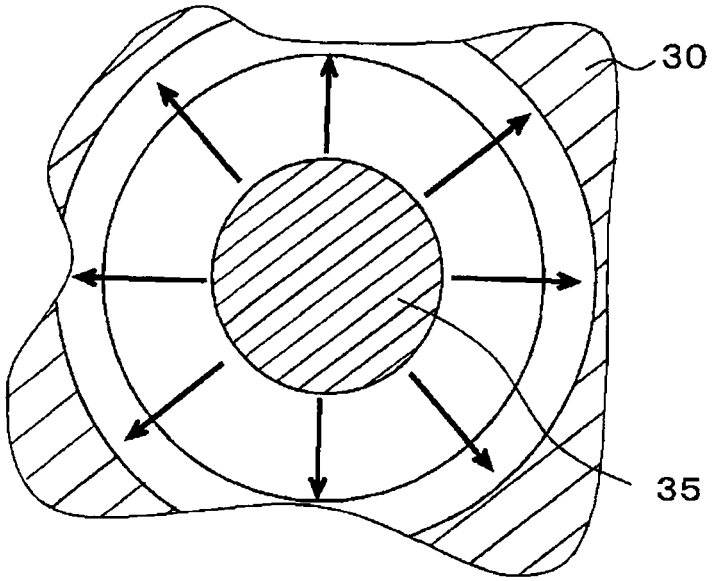
FIG. 7 is a cross-sectional view illustrating a refrigerant flow in the diffuser passage of the ejector according to a modification.

FIG. 7 schematically illustrates the flowing direction of refrigerant flowing along the conical side surface of the passage formation member 35 when viewed in the axial direction as a modification, which is a diagram corresponding to FIG. 4 described in the first embodiment. Even under the above operating conditions, according to the ejector 13 of the present disclosure, since the actuating bar 38 does not produce a passage resistance of the refrigerant flowing through the diffuser passage 13*c*, a reduction in the amount of pressurizing the refrigerant in the diffuser passage 13*c* can be suppressed.

What is claimed is:

1. An ejector for a vapor compression refrigeration cycle device, comprising:

a body part including a swirling space in which a refrigerant flowing from a refrigerant inlet port is swirled, a depressurizing space in which the refrigerant flowing out of the swirling space is depressurized, a suction passage that communicates with a downstream side of the depressurizing space in a refrigerant flow and draws a refrigerant from external to the ejector, and a pressurizing space in which an ejection refrigerant jetted from the depressurizing space is mixed with a suction refrigerant drawn from the suction passage; and a passage formation member which is at least partially arranged inside the depressurizing space and inside the pressurizing space, and has a conical shape in which a cross-sectional area increases with distance from the depressurizing space, wherein the body part includes a plurality of members having at least a nozzle body defining the depressurizing space, the nozzle body being located radially outward of the passage formation member, a refrigerant passage provided between an inner peripheral surface of a portion of the nozzle body, which defines the depressurizing space, and an outer peripheral surface of the passage formation member is a nozzle passage functioning as a nozzle that depressurizes and jets the refrigerant flowing out of the swirling space, a refrigerant passage provided between an inner peripheral surface of a portion of the body part, which defines the pressurizing space, and an outer peripheral surface of the passage formation member is a diffuser passage functioning as a diffuser that pressurizes a mixture of the ejection refrigerant and the suction refrigerant, and the diffuser passage has an annular shape in a cross-section surface perpendicular to an axial direction of the passage formation member, the ejector further comprising a driving device that displaces the nozzle body relative to the passage formation member to change a refrigerant passage area of the nozzle passage.

2. The ejector according to claim 1, wherein the driving device is arranged outward of the passage formation member in a radial direction of the passage formation member.

3. The ejector according to claim 2, wherein the driving device transmits a driving force to the nozzle body to move away from an apex part of the passage formation member in an axial direction of the passage formation member.

4. The ejector according to claim 1, wherein the driving device includes a sealed space in which a temperature sensitive medium that changes in pressure according to a temperature change is sealed, and a pressure responsive member that is displaced according to the pressure of the temperature sensitive medium in the sealed space.

5. The ejector according to claim 1, further comprising a coupling member that couples the driving device with the nozzle body, wherein the coupling member is arranged without crossing the diffuser passage.

6. The ejector according to claim 1, further comprising a coupling member that couples the driving device with the nozzle body, wherein the coupling member is arranged outside of the diffuser passage.

7. The ejector according to claim 1, further comprising a fixed portion that is fixed to the body part, wherein the fixed portion has a through-hole in a center part thereof, the nozzle body is arranged in the through-hole of the fixed portion, the fixed portion houses the driving device around the through-hole, and the nozzle body has a flange part coupled with the driving device on an opposite side of the fixed portion from the passage formation member.

8. The ejector according to claim 1, wherein the body part includes a gas-liquid separation space that separates the refrigerant flowing out of the pressurizing space into gas and liquid.

9. The ejector according to claim 1, wherein the refrigerant flowing in the diffuser passage swirls around an axis of the passage formation member.

10. The ejector according to claim 1, wherein the body part further includes a refrigerant inlet passage connecting the refrigerant inlet port and the swirling space, and the refrigerant inlet passage extends to the swirling space in a tangential direction relative to the swirling space.

* * * * *